US011130344B2

(12) United States Patent
Masuda et al.

(10) Patent No.: US 11,130,344 B2
(45) Date of Patent: Sep. 28, 2021

(54) PRINTING APPARATUS AND PRINTING METHOD

(71) Applicant: SEIKO EPSON CORPORATION, Tokyo (JP)

(72) Inventors: Norihiro Masuda, Shiojiri (JP); Kenji Otokita, Yamagata-mura (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/832,957

(22) Filed: Mar. 27, 2020

(65) Prior Publication Data

US 2020/0307221 A1 Oct. 1, 2020

(30) Foreign Application Priority Data

Apr. 1, 2019 (JP) ..... JP2019-069695

(51) Int. Cl.
*B41J 2/17* (2006.01)
*B41J 11/00* (2006.01)
*B41J 2/165* (2006.01)

(52) U.S. Cl.
CPC ..... *B41J 2/1714* (2013.01); *B41J 2/16511* (2013.01); *B41J 11/002* (2013.01)

(58) Field of Classification Search
CPC ..... B41J 2/1714
See application file for complete search history.

(56) References Cited

U.S. PATENT DOCUMENTS

2013/0229458 A1* 9/2013 Masuda ..... B41J 2/1652 347/30
2014/0240418 A1 8/2014 Masuda
2020/0361209 A1* 11/2020 Hayasaka ..... B41J 2/1714

FOREIGN PATENT DOCUMENTS

JP 2014-162121 9/2014

* cited by examiner

*Primary Examiner* — Justin Seo
(74) *Attorney, Agent, or Firm* — Workman Nydegger

(57) ABSTRACT

A printing apparatus is provided that includes a line type printing head ejecting an UV ink onto a base material, an ultraviolet irradiator disposed downstream of the printing head, a mist retrieving section having a suction port and disposed between the printing head and the ultraviolet irradiator, and a control unit, wherein when printing is performed, the control unit adjusts, in accordance with a transport speed of the base material, at least one of a gap A, a gap B, and a suction air volume of the mist retrieving section such that a direction of an airflow passing through a gap between the base material and the ultraviolet irradiator is opposite the transport direction of the base material. The gap A is a gap between the printing head and the mist retrieving section, and the gap B is a gap between the base material and the suction port.

6 Claims, 7 Drawing Sheets

| TRANSPORT SPEED (m/min) | GAP C (mm) | GAP A (mm) | GAP B (mm) | SUCTION AIR VOLUME FAN VOLTAGE (V) | WIND SPEED IN GAP B (m/sec) |
|---|---|---|---|---|---|
| 7.5 | 0.6 | 5.0 | 3.5 | 1.0 | +2.0 |
| | | | | 1.5 | +1.0 |
| | | | | 2.0 | -2.0 |
| 15 | 0.6 | 5.0 | 3.5 | 2.0 | +2.0 |
| | | | | 2.5 | +1.0 |
| | | | | 3.0 | -2.0 |
| 30 | 0.6 | 5.0 | 3.5 | 3.0 | +2.0 |
| | | | | 3.5 | +1.0 |
| | | | | 4.0 | -2.0 |
| 50 | 0.6 | 5.0 | 3.5 | 4.0 | +2.0 |
| | | | | 4.5 | +1.0 |
| | | | | 5.0 | -2.0 |

FIG. 4

| TRANSPORT SPEED (m/min) | GAP C (mm) | GAP A (mm) | GAP B (mm) | SUCTION AIR VOLUME FAN VOLTAGE (V) | WIND SPEED IN GAP B (m/sec) | INFLUENCE ON EJECTION | INFLUENCE ON IRRADIATION |
|---|---|---|---|---|---|---|---|
| 7.5 | 0.6 | 4.0 | 3.0 | 2.0 | -5.0 | NG | OK |
| | | | 3.5 | | -4.0 | | |
| | | | 4.0 | | -3.0 | | |
| | | 5.0 | 3.0 | | -2.0 | OK | OK |
| | | | 3.5 | | -1.0 | | NG |
| | | | 4.0 | | 0 | | |
| | | 6.0 | 3.0 | | +1.0 | OK | NG |
| | | | 3.5 | | +2.0 | | |
| | | | 4.0 | | +3.0 | | |
| 15 | 0.6 | 3.0 | 2.5 | 2.0 | -5.0 | NG | OK |
| | | | 3.0 | | -4.0 | | |
| | | | 3.5 | | -3.0 | | |
| | | 4.0 | 2.5 | | -2.0 | OK | OK |
| | | | 3.0 | | -1.0 | | NG |
| | | | 3.5 | | 0 | | |
| | | 5.0 | 2.5 | | +1.0 | OK | NG |
| | | | 3.0 | | +2.0 | | |
| | | | 3.5 | | +3.0 | | |
| 30 | 0.6 | 2.0 | 2.0 | 2.0 | -5.0 | NG | OK |
| | | | 2.5 | | -4.0 | | |
| | | | 3.0 | | -3.0 | | |
| | | 3.0 | 2.0 | | -2.0 | OK | OK |
| | | | 2.5 | | -1.0 | | NG |
| | | | 3.0 | | 0 | | |
| | | 4.0 | 2.0 | | +1.0 | OK | NG |
| | | | 2.5 | | +2.0 | | |
| | | | 3.0 | | +3.0 | | |
| 50 | 0.6 | 1.0 | 1.5 | 2.0 | -5.0 | NG | OK |
| | | | 2.0 | | -4.0 | | |
| | | | 2.5 | | -3.0 | | |
| | | 2.0 | 1.5 | | -2.0 | OK | OK |
| | | | 2.0 | | -1.0 | | NG |
| | | | 2.5 | | 0 | | |
| | | 3.0 | 1.5 | | +1.0 | OK | NG |
| | | | 2.0 | | +2.0 | | |
| | | | 2.5 | | +3.0 | | |

FIG. 7

PRINTING APPARATUS AND PRINTING METHOD

The present application is based on, and claims priority from JP Application Serial Number 2019-069695, filed Apr. 1, 2019, the disclosure of which is hereby incorporated by reference herein in its entirety.

BACKGROUND

1. Technical Field

The present disclosure relates to a printing apparatus and a printing method.

2. Related Art

In the past, in a printing apparatus that uses an ultraviolet-curable ink, a suction port for retrieving ink mist and an ultraviolet irradiator are installed downstream a printing head in a transport direction. The suction port is installed so as to contact the ultraviolet irradiator in order to prevent attachment of the ink mist to the ultraviolet irradiator (see JP-A-2014-162121).

However, JP-A-2014-162121 describes retrieval of mist generated when an ink droplet is ejected from the printing head with the above configuration, but there is no suggestion in terms of improving retrieval efficiency of the mist.

In association with speeding up of printing in recent printing apparatuses, an amount of mist increases, thus improving the retrieval efficiency of the mist becomes a problem.

SUMMARY

A printing apparatus of the present application is a printing apparatus that includes a line type printing head configured to eject an ultraviolet-curable ink onto a base material, an ultraviolet irradiator disposed downstream of the printing head in a transport direction of the base material, a mist retrieving section having a suction port and disposed between the printing head and the ultraviolet irradiator in the transport direction of the base material, and a control unit, wherein when printing is performed with the ultraviolet-curable ink being ejected toward the base material to be transported form, the control unit adjusts, in accordance with a transport speed of the base material, at least one of a gap A and a gap B described below, and a suction air volume of the mist retrieving section such that a direction of an airflow passing through a gap between the base material and the ultraviolet irradiator is opposite the transport direction of the base material:

Gap A: a gap between the printing head and the mist retrieving section

Gap B: a gap between the base material and the suction port.

When the suction air volume is adjusted with the gap A and the gap B being fixed, the suction air volume when the transport speed is a second transport speed is caused to be greater than the suction air volume when the transport speed is a first transport speed, the second transport speed being faster than the first transport speed to be larger.

The printing apparatus described above, in the transport direction of the base material, may include a shutter capable of adjusting an open/close amount and provided between a suction duct including the suction port provided at one end of the mist retrieving section, and the printing head, and may adjust the open/close amount of the shutter when the gap A is adjusted.

In the printing apparatus described above, the suction duct may include an auxiliary duct that is movable to and from the base material, and the auxiliary duct may be moved when the gap B is adjusted.

A printing method of the present application is a printing method for a printing apparatus that includes a line type printing head configured to eject an ultraviolet-curable ink onto a base material, an ultraviolet irradiator disposed downstream of the printing head in a transport direction of the base material, and a mist retrieving section having a suction port and disposed between the printing head and the ultraviolet irradiator in the transport direction of the base material, the printing method including an adjustment step for, when printing is performed with the ultraviolet-curable ink being ejected toward the base material to be transported, adjusting, in accordance with a transport speed of the base material, at least one of a gap A and a gap B described below, and a suction air volume of the mist retrieving section such that a direction of an airflow passing through a gap between the base material and the ultraviolet irradiator is opposite the transport direction of the base material:

Gap A: a gap between the printing head and the mist retrieving section

Gap B: a gap between the base material and the suction port.

In the printing method described above, when the suction air volume is adjusted with the gap A and the gap B being fixed, the adjustment step may include a step for increasing the suction air volume when the transport speed is a second transport speed to be greater than the suction air volume when the transport speed is a first transport speed, the second transport speed being faster than the first transport speed.

In the printing method described above, in the transport direction of the base material, a shutter capable of adjusting an open/close amount is provided between a suction duct including the suction port provided at one end of the mist retrieving section, and the printing head, and the adjustment step may include an open/close amount adjustment step for adjusting the open/close amount of the shutter in order to adjust the gap A.

In the printing method described above, the suction duct may include an auxiliary duct that is movable to and from the base material, and the adjustment step may include, in order to adjust the gap B, a movement amount adjustment step for adjusting a movement amount of the auxiliary duct.

BRIEF DESCRIPTION OF THE DRAWINGS

FIG. 4 is a diagram illustrating a confirmation result when only suction air volume is adjusted to generate an airflow in an opposite direction in the gap B.

FIG. 7 is a diagram illustrating a confirmation result when the gap A and the gap B are adjusted to generate an airflow in an opposite direction in the gap B.

DESCRIPTION OF EXEMPLARY EMBODIMENTS

Figure 2:
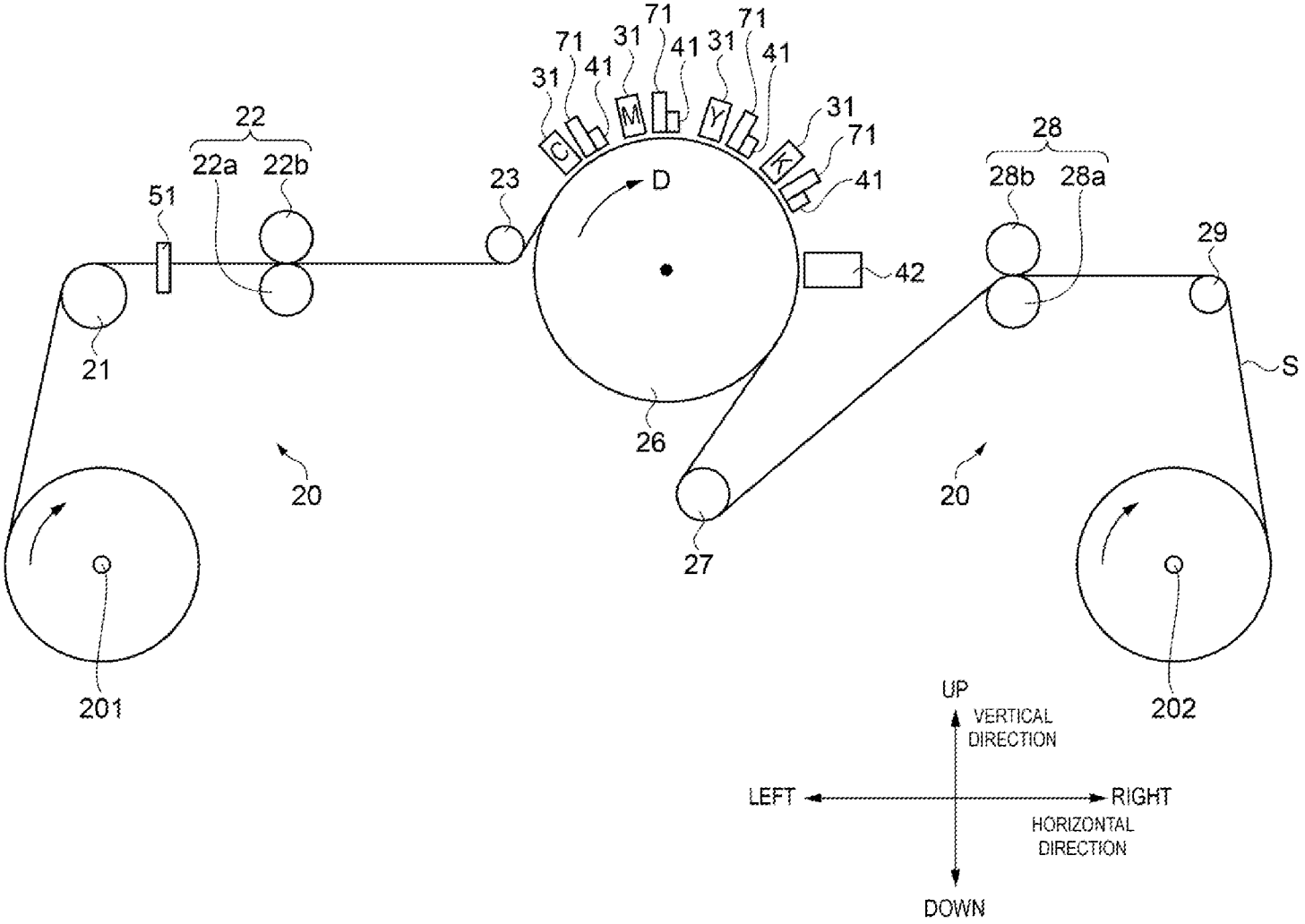
FIG. 2 is a schematic view of a transport path including a printed region.
Figure 3:
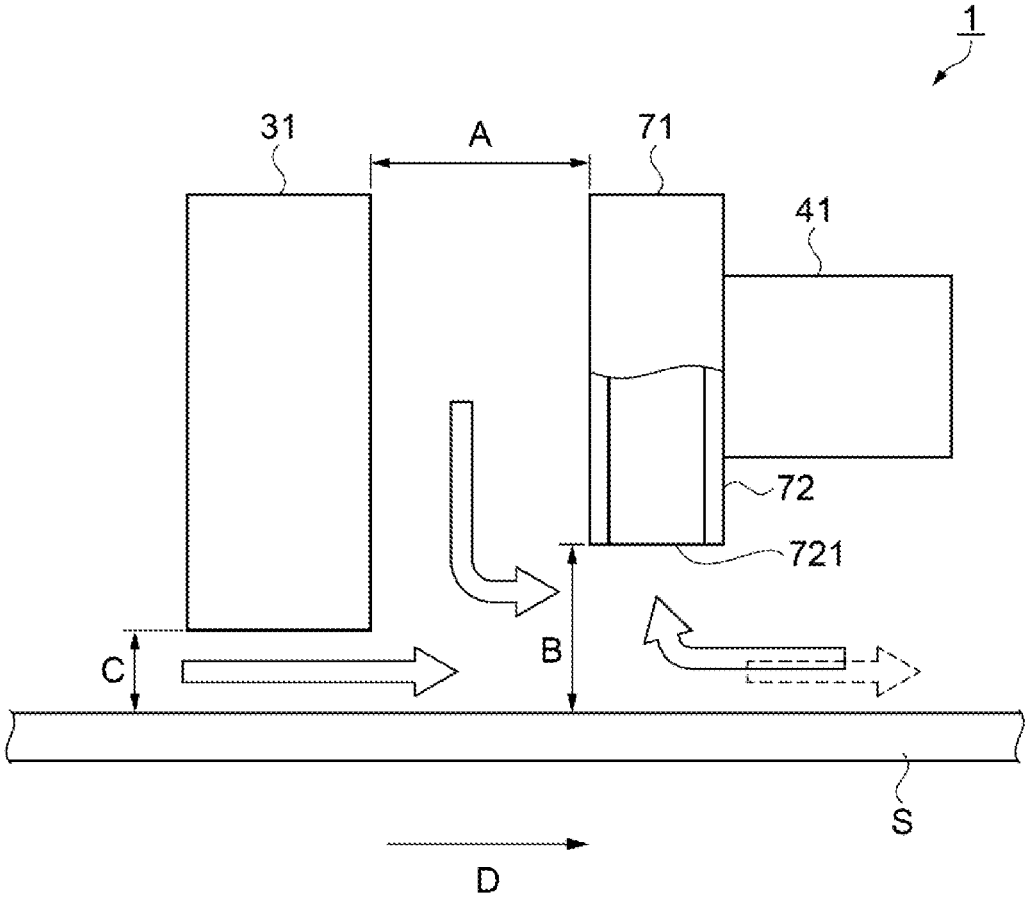
FIG. 3 is a schematic side view illustrating a printing head, a mist retrieving section, a temporary curing irradiation section, and a base material.
Figure 6:
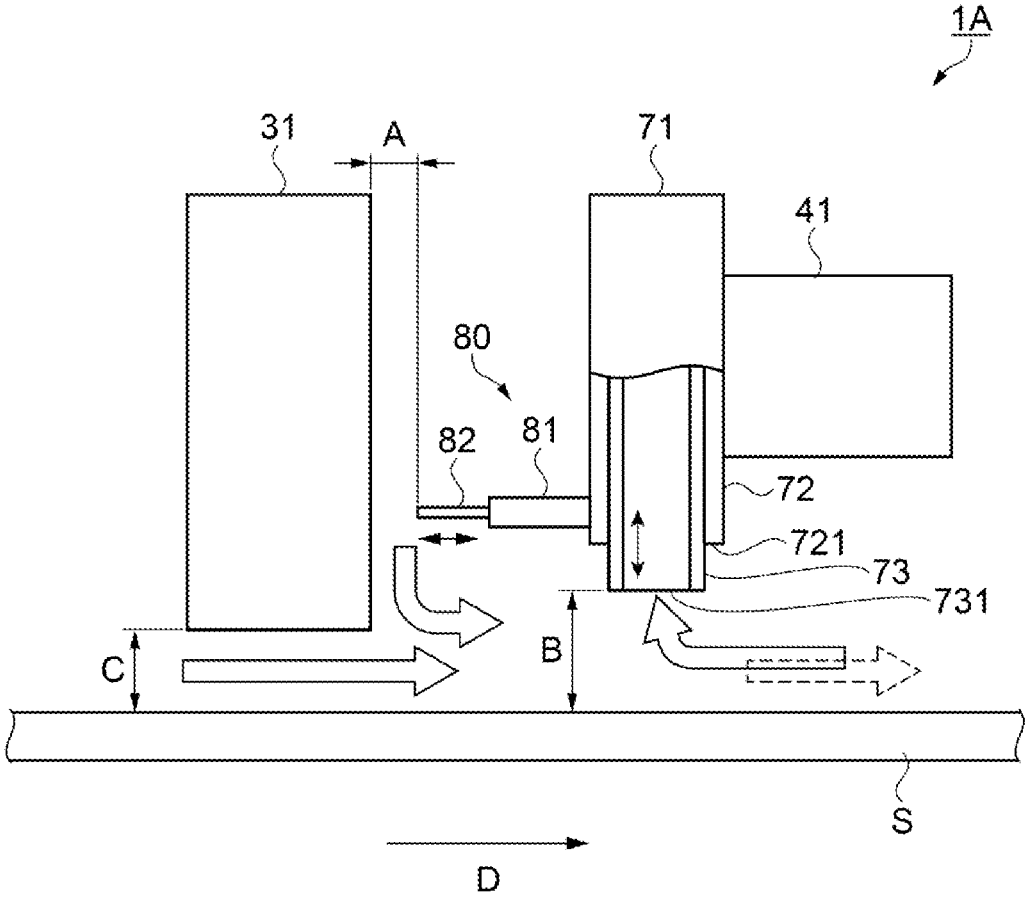
FIG. 6 is a schematic side view illustrating a printing head, a mist retrieving section, a temporary curing irradiation section, and a base material.

An outline of a printing apparatus according to embodiments will be described with reference to the accompanying drawings. In the present embodiment, as an example of a base material for printing an image, the printing apparatus is a printing apparatus that transports a sheet (continuous sheet) wound in a roll shape in a roll-to-roll type. An ink jet printer 1 (hereinafter, simply referred to as the printer 1) as an example of the printing apparatus will be described. Note that, FIG. 2, FIG. 3, and FIG. 6 are illustrated with scales changed for convenience of explanation.

First Embodiment

Figure 1:
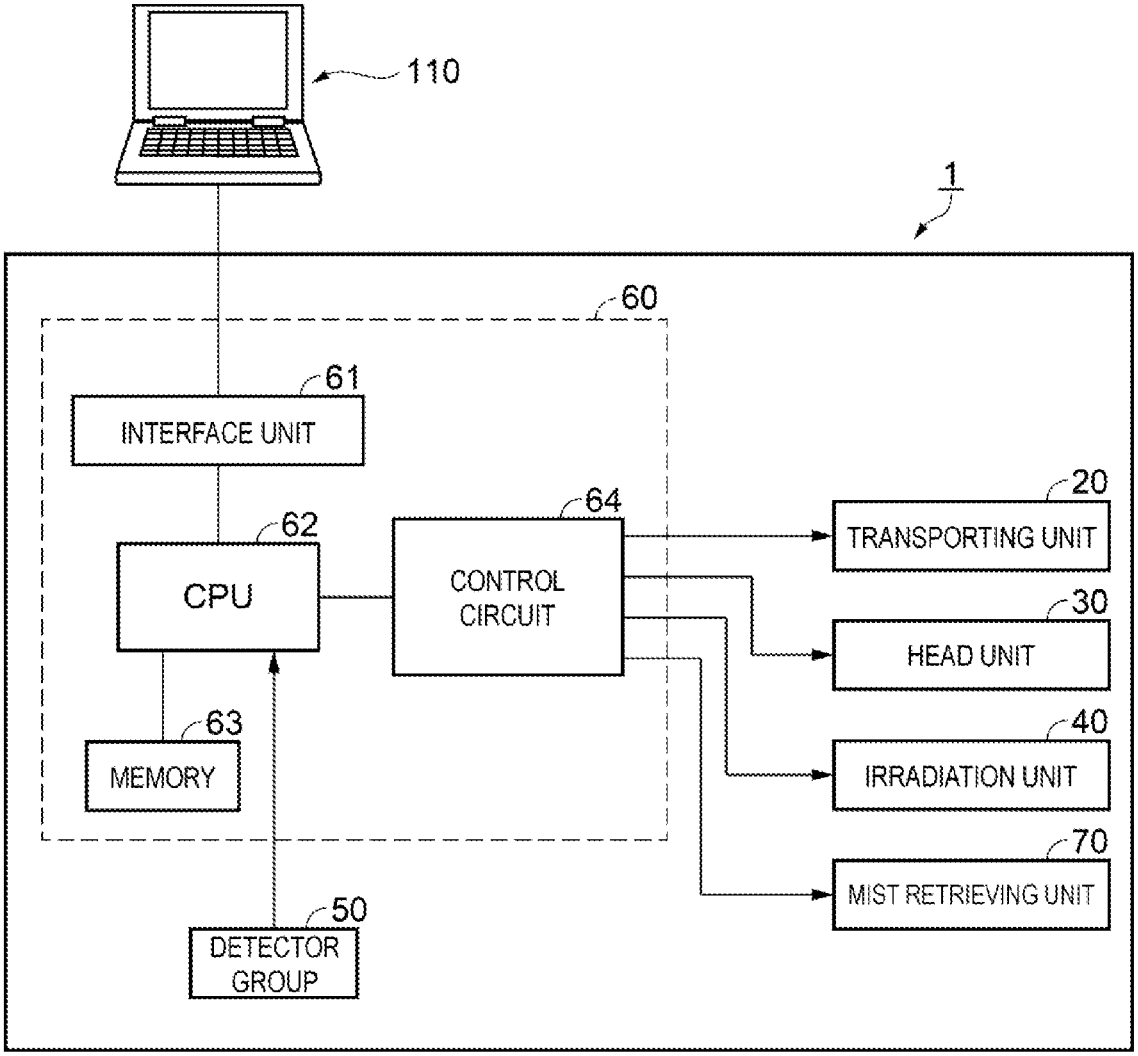
FIG. 1 is a block diagram of an overall configuration of a printer according to a first embodiment.

FIG. 1 is a block diagram of an overall configuration of the printer 1 according to the present embodiment. FIG. 2 is a schematic view of a transport path including a printed region. The printer 1 is a printing apparatus for printing an image on a paper-based, or film-based base material S, and is communicably coupled to a computer 110, which is an external device. Note that, as for types of the base material S, specific examples of a paper type include a high-quality paper, cast paper, art paper, coated paper and the like, and specific examples of a film type include synthetic paper, polyethylene terephthalate (PET), polypropylene (PP) and the like.

A printer driver is installed on the computer 110. The printer driver is a program for causing a display device (not illustrated) to display a user interface, and convert image data outputted from an application program into print data.

The printer driver is recorded in a recording medium (recording medium readable by the computer) such as a CD-ROM. Alternatively, the printer driver can be downloaded to the computer 110 via the Internet. In order to cause the printer 1 to print an image, the computer 110 outputs print data corresponding to the image to be printed to the printer 1.

The printer 1 of the present embodiment is an apparatus for printing an image on the base material S, by ejecting, as an example of liquid, an ultraviolet-curable ink (hereinafter, referred to as a UV ink) that cures by being irradiated with ultraviolet light (Ultra Violet Light: hereinafter, abbreviated as "UV"), that is a type of light. The UV Ink is ink containing an ultraviolet light curing resin, and when irradiated with UV, cures due to the photopolymerization reaction occurring in the ultraviolet light curing resin. Note that, the printer 1 of the present embodiment uses four color UV inks (color inks) for cyan (C), magenta (M), yellow (Y), and black (K) to print an image.

As illustrated in FIG. 1, the printer 1 includes a transporting unit 20, a head unit 30, an irradiation unit 40, a detector group 50, and a controller 60. The printer 1, after receiving print data from the computer 110, controls each of the units (the transporting unit 20, the head unit 30, and the irradiation unit 40) by the controller 60, to print an image on the base material S in accordance with the print data. The controller 60 controls each of the units, based on the print data received from the computer 110, and prints the image on the base material S. A state in the printer 1 is monitored by detector group 50, and the detector group 50 outputs detection results to controller 60. The controller 60 controls each of the units, based on the detection results outputted from the detector group 50.

The transporting unit 20 transports the base material S along a preset transport path. As illustrated in FIG. 2, the transporting unit 20 includes a feeding shaft 201 around which the base material S is wound and that is rotatably supported, a relay roller 21, first transport rollers 22 (first driving roller 22*a*, first driven roller 22*b*), a relay roller 23, and a transport drum 26, a tension roller 27, second transport rollers 28 (second driving roller 28*a*, second driven roller 28*b*), a tension roller 29, and a winding shaft 202 that winds the base material S passing through the tension roller 29. Note that, the transport path for transporting the base material S is formed by the base material S moving sequentially through each of the rollers.

The transport drum 26 is a cylindrical transport member, supports the base material S on a circumferential surface, and transports the base material S in a transport direction D. The transport drum 26 faces each the printing heads 31 and each the temporary curing irradiation section 41 and the actual curing irradiation section 42 described below with the base material S interposed therebetween. Furthermore, the base material S is transported so as to be in close contact with the transport drum 26 at a predetermined tension.

The head unit 30 ejects the UV ink onto the base material S. The head unit 30 forms a dot on the base material S and prints an image by ejecting ink from each of printing heads 31 onto the base material S being transported. Note that, each of the printing heads 31 of the head unit 30 of the present embodiment can form dots for a paper width of the base material S at a time. The printing heads 31 configures a so called line type.

Additionally, as described above, in the present embodiment, the four color inks for image forming are used as the UV inks. As illustrated in FIG. 2, in order from an upstream side in the transport direction D, the respective printing heads 31 ejecting the UV inks of cyan (C), magenta (M), yellow (Y), and black (K) are provided so as to face the circumferential surface of the transport drum 26.

The irradiation unit 40 irradiates with UV toward the UV ink landed on the base material S. The dot formed at the base material S cures by being irradiated with UV from the irradiation unit 40. The irradiation unit 40 of the present embodiment includes a temporary curing irradiation section 41 and an actual curing irradiation section 42 as ultraviolet irradiators.

The detector group 50 includes an end detection sensor 51, a rotary encoder (not illustrated), a paper detection sensor (not illustrated), and the like. The end portion detection sensor 51 detects an end in a width direction of the base material S, and detects meandering of the base material S. The rotary encoder detects respective amounts of rotation of the first driving roller 22*a* and the second driving roller 28*a*. An amount of transportation of the base material S can then be detected, based on a detection result of the rotary encoder.

The controller 60 is a control unit for controlling the printer 1. The controller 60 as the control unit includes an interface unit 61, a CPU 62, a memory 63, and a control circuit 64. The interface unit 61 communicates data between the computer 110 and the printer 1. The CPU 62 is an arithmetic processing device for controlling the printer as a whole. The memory 63 secures a region for storing programs for the CPU 62, a working region, and the like, and includes storage elements such as a RAM and an EEPROM. Further, the memory 63 also includes a table described below. The CPU 62 controls each of the units via the control circuit 64, according to the programs stored in the memory 63.

A mist retrieving unit 70 retrieves mist of ink droplets ejected from each of the printing heads 31. Note that, mist is a microdroplet that is smaller than ink droplets (specifically, a grain diameter size is approximately 0.5 to 10 μm), and is generated when ink droplets are ejected from a nozzle of the printing head 31. The printer 1 of the present embodiment includes a mist retrieving section 71 for retrieving mist for the printing head 31 of each of the colors. Specifically, the printer 1 includes the mist retrieving section 71 downstream the printing head 31 of each of the colors in the transport direction D.

As described above, the printer 1 of the present embodiment includes the four printing heads 31 for the respective ink colors (C, M, Y, and K). The respective printing heads 31 eject the UV inks (color inks) for printing images for the ink colors.

In the present embodiment, the printing heads 31 of the respective colors have an identical configuration, and nozzles that eject the UV ink are arranged in a row in a nozzle row direction at predetermined intervals on each of the printing heads 31. Specifically, in the printer 1 of the present embodiment, the nozzles of the printing head 31 are arranged at an interval of 600 dpi (1/600 inches) (nozzle pitch) along the nozzle row direction. Note that, the nozzle row direction is a direction intersecting the transport direction D of the base material S (a paper width direction of the base material S).

In addition, a length in the nozzle row direction (paper width direction) of the printing head 31 is larger than the paper width of the base material S. This allows for formation of dots with resolution of 600 dpi in the paper width direction. Furthermore, the resolution in the transport direction D can be adjusted by an ejection timing of ink from the nozzles or a transport speed. In the present embodiment, dots are formed at resolution of 600 dpi in the transport direction D as well (print resolution is 600×600 dpi).

Piezo elements are respectively provided so as to correspond to the nozzles of the printing head 31. Then, based on application of a drive signal to the piezo element by the controller 60, ink is ejected from the nozzle corresponding to the piezo element.

When the printer 1 starts printing, the base material S is disposed in advance in the transport path, in a state of being along the circumferential surface of the transport drum 26. The base material S is applied with tension by output torque of the feeding shaft 201, the winding shaft 202, and the second transport roller 28. Specifically, in a feeding section for the base material S, predetermined tension is applied by brake torque of the feeding shaft 201 in accordance with a roll diameter of the base material S.

In a printed region portion, tension is detected by the tension roller 27, and torque of a motor (not illustrated) of the second transport roller 28 is controlled such that predetermined tension is applied. In a winding unit, tension is detected by the tension roller 29, and torque of a motor (not illustrated) of the winding shaft 202 is controlled such that predetermined tension is applied. Each the tension is predetermined in accordance with the roll diameter of the base material S.

When the printer 1 receives print data from the computer 110, the controller 60 rotates a motor (not illustrated) of the first transport roller 22 at a constant speed. As described above, in a state where the tension is applied to the base material S, the base material S is transported in the transport direction D at the constant speed, by the first transport roller 22 rotating at the constant speed. The transport drum 26 is driven to rotate in the transport direction D due to a friction force with the base material S, in accordance with the transport of the base material S.

In the present embodiment, the printing head 31 is concentric with respect to a center of the transport drum 26, is distanced from the base material S on the circumferential surface by a predetermined distance, and is fixed with a predetermined pitch from the next printing head 31. The base material S on the circumferential surface of the transport drum 26, rotates the transport drum 26 to move in the transport direction D, with respect to each of the printing heads 31 installed in this manner.

The controller 60, while the base material S is being transported on the circumferential surface of the transport drum 26, based on the print data received from the computer 110, causes the nozzles of each of the printing heads 31 of the head unit 30 to intermittently eject ink droplets. This operation forms dots on the base material S. Further, the controller 60 causes each irradiation section of the irradiation unit 40 to irradiate with UV, and also causes the mist retrieving unit 70 to retrieve mist.

Specifically, at first, when the base material S passes under the printing head 31 for cyan, the controller 60 causes the printing head 31 for cyan to eject the cyan ink, and prints cyan (color). Thereafter, the controller 60 causes the mist retrieving section 71 downstream the printing head 31 for cyan in the transport direction D, to retrieve mist generated when the printing head 31 for cyan ejects the cyan ink. Furthermore, the temporary curing irradiation section 41 disposed in the mist retrieving section 71 is caused to irradiate with UV, to cause the cyan ink landed on the base material S to temporarily cure.

The operations described above are performed similarly for other color inks. Finally, the controller 60 causes the actual curing irradiation section 42 to irradiate with UV, to cause each of the dots on the base material S to fully cure.

In the printer 1 of the present embodiment, as the irradiation unit 40, the temporary curing irradiation section 41 and the actual curing irradiation section 42 are included, and curing occurs in two stages, that is, temporary curing and actual curing, after forming the dots. Functions of each the curing will be described below.

The temporary curing is curing to suppress bleeding between inks and spreading of a dot, by causing a surface of the dot to cure. In UV irradiation in the temporary curing, an integrated amount of light per unit area of the base material S is small. Thus, the UV ink (dot) does not fully cure even after the temporary curing. Compared to this, the actual curing is curing to cause ink to fully cure. In UV irradiation in the actual curing, an integrated amount of light per unit area of the base material S is larger than that in the UV irradiation in the temporary curing.

In the printer 1 of the present embodiment, the temporary curing irradiation section 41 is provided for each of the ink colors. In other words, the temporary curing irradiation section 41 is provided at a position distanced by a predetermined distance downstream the printing head 31 for each of the colors in the transport direction D. Furthermore, the actual curing irradiation section 42 is provided downstream each of the printing heads 31 and the temporary curing irradiation section 41 in the transport direction D.

Respective lengths in a paper width direction of the temporary curing irradiation section 41 and the actual curing irradiation section 42 are substantially identical to a length in the paper width direction of the printing head 31. In addition, in the present embodiment, the temporary curing irradiation section 41 and the actual curing irradiation section 42 each include a Light Emitting Diode (abbreviated as an LED below) as a light source of UV. An amount of UV (amount of light) irradiated from each of the irradiation sections is controlled by the controller 60 changing an input current to the LED.

FIG. 3 is a schematic side view illustrating the printing head 31, the mist retrieving section 71, the temporary curing irradiation section 41, and the base material S. Referring to FIG. 3, factors for improving retrieval efficiency of mist will be described.

In FIG. 3, the base material S is transported in a horizontal direction in order to simplify the description. In other words, the transport direction D faces from a left side to a right side in the figure. Then, the printing head 31, the mist retrieving section 71, and the temporary curing irradiation section 41 are disposed from the left side (upstream side) so as to face the base material S. Note that, the temporary curing irradiation section 41 is simplified hereinafter and referred to as the irradiation section 41, and the description will be given.

As illustrated in FIG. 3, the mist retrieving section 71 is disposed at a distance (gap) downstream the printing head 31 in the transport direction D. Note that, the mist retrieving section 71 is disposed upstream the irradiation section 41. In addition, the mist retrieving section 71 includes, at one end that is a side of the base material S, a suction duct 72 provided with a suction port 721 facing the base material S. The other mist retrieving sections 71 have a similar configuration.

Here, a gap between the printing head 31 and the mist retrieving section 71 is referred to as the gap A. Also, a gap between the suction port 721 of the mist retrieving section 71 (suction duct 72) and the base material S is referred to as the gap B. A gap between the printing head 31 and the base material S is referred to as a gap C.

In addition, in FIG. 3, directions of respective solid arrows indicate ideal air flow directions. Note that, when the base material S is transported in the transport direction D at a predetermined transport speed, air around the base material S normally moves along the transport direction D, and an airflow that flows downstream is generated. When the mist retrieving section 71 is not operating, even in a region sandwiched between the irradiation section 41 and the base material S, as indicated by a dashed arrow, an air flow that flows downstream is generated.

In the present embodiment, a gap between the base material S and the suction port 721 of the suction duct 72 is set to be smaller than a gap between the base material S and the irradiation section 41. In other words, the suction port 721 is positioned closer to a side of the base material S than the irradiation section 41. Accordingly, an airflow passing through the gap between the base material S and the irradiation section 41 is dependent on the gap between the base material S and the suction port 721 of the suction duct 72, and thus, a gap between the base material S and the suction port 721 is defined as the gap B.

Note that, when there is no mist retrieving section 71, mist generated when ink is ejected from the printing head 31 rides on this airflow and flows, and easily attaches to the irradiation section 41 disposed downstream the printing head 31. Since the mist attaches to the irradiation section 41, it becomes impossible to give a prescribed amount of ultraviolet light irradiation to the printed base material S, causing defects such as bleeding of printing or the like to occur.

Thus, it is necessary to install the mist retrieving section 71 upstream the irradiation section 41, and suction the mist before the mist attaches to the irradiation section 41. Specifically, as indicated by the solid arrow, in the region sandwiched between the irradiation section 41 and the base material S, an airflow in a direction opposite to the airflow that flows downstream (arrow indicated by the dashed line) needs to be generated such that the mist is suctioned by the mist retrieving section 71. In other words, a direction of an airflow passing through the gap B between the base material S and the suction port 721 needs to be in a direction opposite to the transport direction D of the base material S (upstream direction).

In the present embodiment, as main factors for the direction of the airflow passing through the gap B between the base material S and the suction port 721 to be in the direction opposite to the transport direction D of the base material S, the gap A, the gap B, the gap C, and suction air volume of the mist retrieving section 71 can be cited. Then, the inventor adjusted values of the respective factors (gap A, gap B, and suction air volume), and performed confirmation to cause the direction of the airflow passing through the gap B between the base material S and the suction port 721 to be in the direction opposite to the transport direction D of the base material S.

Note that, the gap C that is the gap between the printing head 31 and the base material S is a value that is initially determined to ensure that an ink droplet ejected from the printing head 31 lands at a predetermined position on the base material S, and is not to be adjusted, thus, the gap C as the value to be fixed was excluded from the factors.

FIG. 4 is a diagram illustrating a confirmation result when only suction air volume is adjusted to generate an airflow in an opposite direction in the gap B.

In the present embodiment, four types are provided for the transport speed of the base material S. Specifically, 7.5 m/min, 15 m/min, 30 m/min, 50 m/min are included as the transport speed. Additionally, the gap A is fixed to 5.0 mm, and the gap B is fixed to 3.5 mm. In addition, the gap C between the printing head 31 and the base material S is fixed to 0.6 mm.

Note that, a drive voltage (fan voltage (V)) of a fan to suction is adjusted as the suction air volume. Then, a case was confirmed in which, the fan voltage was adjusted in accordance with each the transport speed, and the airflow in the opposite direction occurs in the gap B. A case in FIG. 4 in which the wind speed in the gap B is denoted as plus (+) indicates that the airflow flows downstream, and a case in which the wind speed is denoted as minus (−) indicates that the airflow flows in the opposite direction.

As a result, it can be seen that when the transport speed is 7.5 m/min, in order for the wind speed in the gap B to be (−), as the suction air volume, 1.0V and 1.5V are insufficient, and 2.0V is sufficient. Additionally, it can be seen that when the transport speed is 15 m/min, in order for the wind speed in the gap B to be (−), as the suction air volume, 2.0V and 2.5V are insufficient, and 3.0V is sufficient. Additionally, it can be seen that when the transport speed is 30 m/min, in order for the wind speed in the gap B to be (−), as the suction air volume, 3.0V and 3.5V are insufficient, and 4.0V is sufficient. Additionally, it can be seen that when the transport speed is 50 m/min, in order for the wind speed in the gap B to be (−), as the suction air volume, 4.0V and 4.5V are insufficient, and 5.0V is sufficient.

As illustrated in FIG. 4, when the transport speed is increased, by increasing the suction air volume to 2.0V, 3.0V, 4.0V, and 5.0V, as well, the airflow in the opposite direction can be generated against the airflow flowing downstream generated by the base material S being transported in the transport direction D at a predetermined transport speed.

Thus, when the gap A and the gap B are fixed and the suction air volume is adjusted, in order to generate the airflow in the opposite direction against the airflow flowing downstream in the gap B, the suction air volume is to be 2.0V when the transport speed is 7.5 m/min. In addition, when the transport speed is 15 m/min that is faster than 7.5 m/min, by setting the suction air volume to be 3.0V that is larger than 2.0V, the airflow in the opposite direction can be generated against the airflow flowing downstream due to the transport speed, in the gap B. This relationship similarly holds also when the transport speed is 30 m/min and 50 m/min.

In other words, in order to generate the airflow in the opposite direction against the airflow flowing downstream in the gap B, it is sufficient to increase, compared to the suction air volume (for example, 2.0V) when the transport speed is a first transport speed (for example, 7.5 m/min), the suction air volume (for example, 3.0V) when the transport speed is a second transport speed (for example, 15 m/min) faster than the first transport speed (7.5 m/min) to be larger.

Note that, it can be said that, as an adjustment step for generating the airflow in the opposite direction against the airflow flowing downstream in the gap B, a step is included, for increasing, compared to the suction air volume when the transport speed is the first transport speed, the suction air volume when the transport speed is the second transport speed faster than the first transport speed to be larger.

Note that, among the three factors, when the gap A and the gap B are fixed and the suction air volume is adjusted, it is sufficient that the suction air volume corresponding to the transport speed for making the airflow in the gap B the airflow in the direction opposite to the transport direction D is stored in the memory 63 as a table.

Accordingly, when the transport speed of the base material S is set at the time of printing, the CPU 62 reads the table from the memory 63 and determines suction air volume corresponding to the set transport speed. Then, the CPU 62 operates the mist retrieving unit 70 via the control circuit 64 to start driving of the fan. With this series of operations, mist is efficiently retrieved by the mist retrieving section 71.

Note that, in the present embodiment, in a state where the two factors, that is, the gap A and the gap B are fixed, of the three factors, the suction air volume of the mist retrieving section 71, that is one of the factors, is adjusted in accordance with the transport speed of the base material S, such that the direction of the airflow passing through the gap between the base material S and the irradiation section 41 (passing through the gap B between the base material S and the suction port 721) is in the direction opposite to the transport direction D of the base material S. In other words, in the present embodiment, the adjustment step is included for adjusting the suction air volume of the mist retrieving section 71, which is one of the three factors, in accordance with the transport speed of the base material S, such that the direction of the airflow is in the direction opposite to the transport direction D of the base material S.

As described above, according to the printer 1, and the printing method for the printer 1 according to the present embodiment, the following advantages can be achieved.

According to the printer 1 of the present embodiment, the controller 60 as the control unit adjusts the suction air volume of the mist retrieving section 71, among the gap A, the gap B, and the suction air volume of the mist retrieving section 71, in accordance with the transport speed of the base material S, such that the direction of the airflow passing through the gap between the base material S and the irradiation section 41 (the gap B between the base material S and the suction port 721) is in the direction opposite to the transport direction D of the base material S. Note that, the gap A is the gap between the printing head 31 and the mist retrieving section 71, and the gap B is the gap between the base material S and the suction port 721.

Accordingly, by adjusting the suction air volume, that is one of the three factors, the direction of the airflow passing through the gap between the base material S and the irradiation section 41 (the gap B between the base material S and the suction port 721) can be made the direction opposite to the transport direction D of the base material S. Thus, it becomes possible to improve the retrieval efficiency of the mist, and it is possible to suppress the mist from attaching to the irradiation section 41, thereby making it possible to suppress defects such as bleeding of printing or the like. In addition, since the retrieval efficiency of the mist can be improved, an increase in an amount of mist associated with speeding up of printing in recent printing apparatuses can be supported.

According to the printer 1 of the present embodiment, when the gap A and the gap B are fixed and the suction air volume is adjusted, compared to the suction air volume when the transport speed is the first transport speed, the suction air volume when the transport speed is the second transport speed faster than the first transport speed is caused to be larger.

In this way, a mechanical and electrical configuration is necessary to adjust the gap A and the gap B, but it is sufficient to adjust the drive voltage of the fan to adjust the suction air volume, thus adjustment is facilitated. Furthermore, when the transport speed of the base material S is increased, it is possible to improve the retrieval efficiency of the mist by adjusting the suction air volume, so as to increase the suction air volume, and the speeding up of printing can be easily supported.

According to the printing method for the printer 1 of the present embodiment, an adjustment step is included in which the controller 60 as the control unit adjusts the suction air volume of the mist retrieving section 71, among the gap A, the gap B, and the suction air volume of the mist retrieving section 71, in accordance with the transport speed of the base material S, such that the direction of the airflow passing through the gap between the base material S and the irradiation section 41 (the gap B between the base material S and the suction port 721) is in the direction opposite to the transport direction D of the base material S.

Since the adjustment step is included for adjusting the suction air volume, that is one of the three factors, the direction of the airflow passing through the gap between the base material S and the irradiation section 41 (the gap B between the base material S and the suction port 721) can be made the direction opposite to the transport direction D of the base material S. Thus, it becomes possible to improve the retrieval efficiency of the mist, and it is possible to suppress the mist from attaching to the irradiation section 41, thereby making it possible to suppress defects such as bleeding of printing or the like. In addition, since the retrieval efficiency of the mist can be improved, an increase in an amount of mist associated with speeding up of printing in recent printing apparatuses can be supported.

According to the printing method for the printer 1 of the present embodiment, when the gap A and the gap B are fixed and the suction air volume is adjusted, the adjustment step includes a step for increasing, compared to the suction air volume when the transport speed is the first transport speed, the suction air volume when the transport speed is the second transport speed faster than the first transport speed to be larger. In this way, a mechanical and electrical configuration is necessary to adjust the gap A and the gap B, but it is sufficient to adjust the drive voltage of the fan to adjust the suction air volume, thus adjustment is facilitated. Furthermore, when the transport speed of the base material S is increased, it is possible to improve the retrieval efficiency of the mist by adjusting the suction air volume, by the step for increasing the suction air volume, and the speeding up of printing can be easily supported.

Second Embodiment

Figure 5:
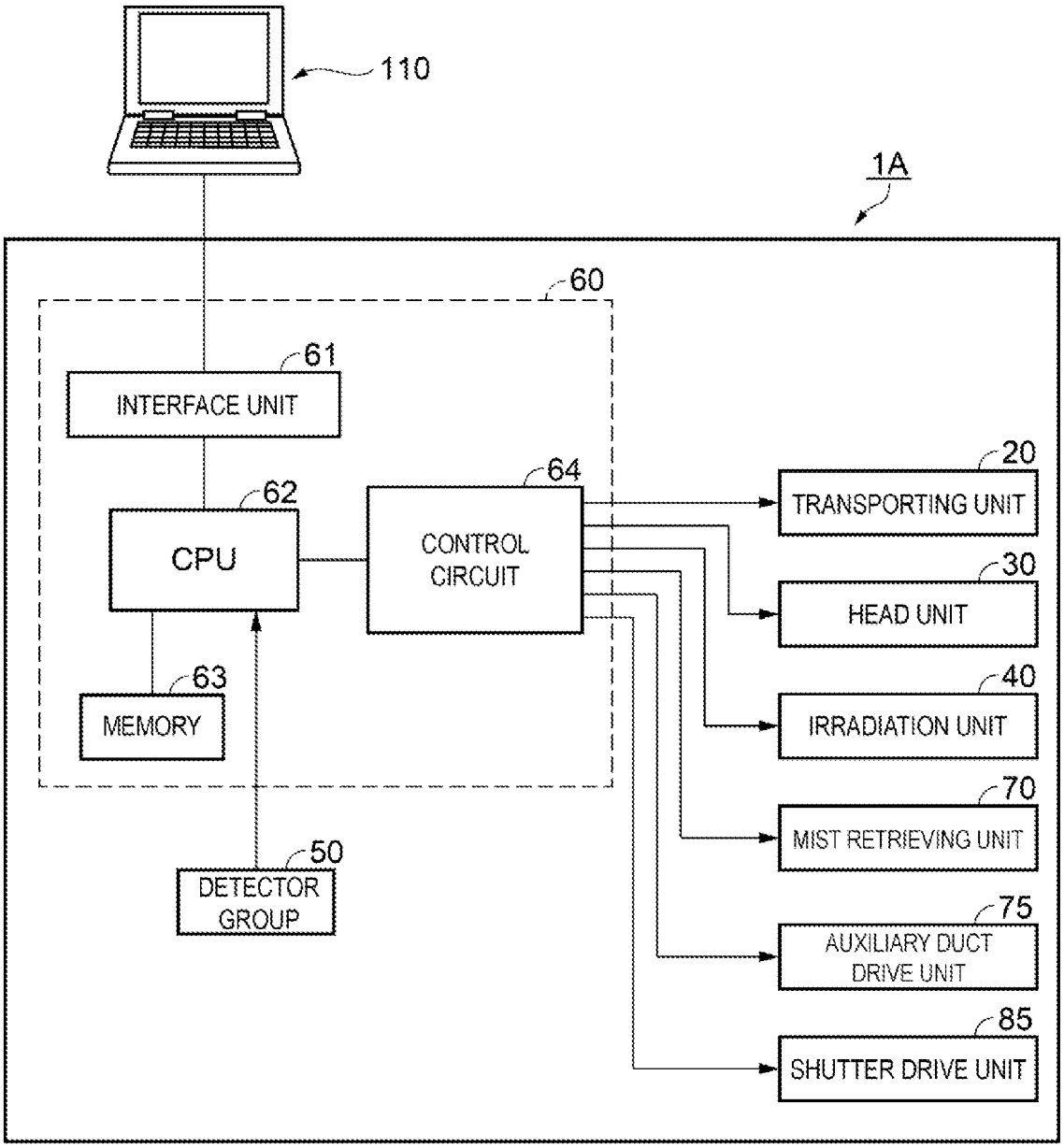
FIG. 5 is a block diagram of an overall configuration of a printer according to a second embodiment.

FIG. 5 is a block diagram of an overall configuration of a printer 1A according to a second embodiment. FIG. 6 is a schematic side view illustrating the printing head 31, the mist retrieving section 71, the temporary curing irradiation section 41 (irradiation section 41), and the base material S according to the present embodiment.

In the printer 1 of the first embodiment, the gap A and the gap B are fixed and the suction air volume of the mist retrieving section 71 is adjusted, whereas the printer 1A of the present embodiment differs in that the suction air volume of the mist retrieving section 71 is fixed and the gap A and the gap B are adjusted. In other words, the printer 1A of the present embodiment includes an adjustment step for adjusting the gap A and an adjustment step for adjusting the gap B in accordance with a transport speed of the base material S, such that a direction of an airflow passing through the gap B is in a direction opposite to the transport direction D of the base material S.

In the present embodiment, as illustrated in FIG. 6, in order to adjust the gap A, a shutter 80 capable of adjusting an open/close amount is provided between the suction duct 72 provided with the suction port 721 and the printing head 31. The shutter 80 is constituted by a base portion 81 and a movement unit 82, and adjusts the gap A (adjusts the open/close amount), by moving the movement unit 82 toward a side of the printing head 31 with respect to the base portion 81.

As illustrated in FIG. 5, the printer 1A of the present embodiment includes a shutter drive unit 85. Then, the CPU 62 determines a value of the gap A corresponding to the transport speed, based on a table stored in the memory 63, which is described later. The CPU 62 drives the shutter drive unit 85 via the control circuit 64 in accordance with a program. In other words, an open/close amount adjustment step for adjusting the open/close amount of the shutter 80 is included, and the gap A is adjusted by performing the step.

In addition, in the present embodiment, as illustrated in FIG. 6, in order to adjust the gap B, in addition to the suction duct 72, an auxiliary duct 73 that is movable to and from the base material S is included. The auxiliary duct 73 has a suction port 731 at a tip portion, and extends and moves in a direction of the base material S from the suction port 721 of the suction duct 72 toward the base material S, thereby adjusting the gap B.

In the present embodiment, the temporary curing irradiation section 41 and the actual curing irradiation section 42 are fixed without moving with respect to the base material S. Also, similar to the first embodiment, a gap between the base material S and the suction port 731 of the auxiliary duct 73 is set to be smaller than a gap between the base material S and the irradiation section 41. Accordingly, the airflow passing through the gap between the base material S and the irradiation unit 41 is dependent on the gap between the base material S and the suction port 731 of the auxiliary duct 73, and thus, the gap between the base material S and the suction port 731 is defined as the gap B.

As illustrated in FIG. 5, the printer 1A of the present embodiment includes an auxiliary duct drive unit 75. Then, the CPU 62 determines a value of the gap B corresponding to the transport speed, based on the table stored in the memory 63, which is described later. The CPU 62 drives the auxiliary duct drive unit 75 via the control circuit 64 in accordance with a program. In other words, a displacement adjustment step for adjusting displacement of the auxiliary duct 73 is included, and the gap B is adjusted by performing the step.

FIG. 7 is a diagram illustrating a confirmation result when the gap A and the gap B are adjusted to generate an airflow in an opposite direction in the gap B.

Note that, in the present embodiment, four types are provided for the transport speed, similar to the first embodiment. Specifically, 7.5 m/min, 15 m/min, 30 m/min, 50 m/min are included as the transport speed. In addition, the gap C between the printing head 31 and the base material S is fixed to 0.6 mm, similar to the first embodiment. Then, suction air volume of the mist retrieving section 71 is fixed as a drive voltage of a fan to 2.0V.

Note that, a case was confirmed in which, the gap A is adjusted by adjusting the open/close amount of the shutter 80 in accordance with each the transport speed, and by adjusting the gap B for each the gap A by moving the auxiliary duct 73, an airflow in an opposite direction occurs in the gap B. Similar to the first embodiment, a case where a wind speed in the gap B in FIG. 7 is denoted as plus (+) indicates that the airflow flows in the transport direction D (downstream side), and a case where the wind speed is denoted as minus (−) indicates that the airflow flows in the direction opposite to the transport direction D.

When influence on ejection, influence on a mist suction amount, influence on attachment of mist to the printing head 31 and the irradiation section 41, and the like, in a case where the wind speed in the opposite direction is high, in a case where the wind speed in the transport direction D is high, or the like, are comprehensively determined in consideration of balance, the inventor considered that the wind speed in the gap B is most desirably about −2.0 m/sec.

Specifically, as illustrated in FIG. 7, regardless of the transport speed, when the wind speed in the opposite direction in the gap B is larger than −2.0 m/sec (for example, −3.0 m/sec, −4.0 m/sec, and the like), a force of drawing downstream on an ink droplet ejected from the printing head 31 increases, a landing position of the ink droplet shifts downstream, and printing position shift occurs. Accordingly, the above combination of the gap A and the gap B is problematic regarding to influence on the ejection and thus classified as "NG (no good)". Note that, a combination not problematic regarding to the influence on the ejection is classified as "OK".

Further, regardless of the transport speed, when the wind speed in the gap B in the transport direction D exceeds −2.0 m/sec (for example, +1.0 m/sec, +2.0 m/sec, and the like), the mist suction amount by the mist retrieving section 71 from the gap B decreases, and mist that cannot be suctioned attaches to the irradiation section 41, and it becomes impossible to perform proper irradiation. Accordingly, the above combination of the gap A and the gap B is problematic regarding to influence on irradiation and thus classified as "NG". Note that, a combination not problematic regarding to the influence on the irradiation is classified as "OK".

Thus, when the transport speed is 7.5 m/min, the gap C is 0.6 mm, and the suction air volume is 2.0V, a condition where the gap A is 4.0 mm, and the gap B is 3.0 mm to 4.0 mm results in "NG" regarding to the influence on the ejection, and a conditions where the gap A is 5.0 mm, the gap B is 3.5 mm to 4.0 mm, and a condition where the gap A is 6.0 mm, and the gap B is 3.0 mm to 4.0 mm result in "NG" regarding to the influence on the irradiation. Thus, when the transport speed is 7.5 m/min, the gap C is 0.6 mm, and the suction air volume is 2.0V, setting the gap A to 5.0 mm and the gap B to 3.0 mm is most suitable for setting the wind speed in the gap B to about −2.0 m/sec.

When the transport speed is 15 m/min, the gap C is 0.6 mm, and the suction air volume is 2.0V, a condition where the gap A is 3.0 mm, and the gap B is 2.5 mm to 3.5 mm results in "NG" regarding to the influence on the ejection, and a conditions where the gap A is 4.0 mm, the gap B is 3.0 mm to 3.5 mm, and a condition where the gap A is 5.0 mm, and the gap B is 2.5 mm to 3.5 mm result in "NG" regarding to the influence on the irradiation. Thus, when the transport speed is 15 m/min, the gap C is 0.6 mm, and the suction air volume is 2.0V, setting the gap A to 4.0 mm and the gap B to 2.5 mm is most suitable for setting the wind speed in the gap B to about −2.0 m/sec.

When the transport speed is 30 m/min, the gap C is 0.6 mm, and the suction air volume is 2.0V, a condition where the gap A is 2.0 mm, and the gap B is 2.0 mm to 3.0 mm results in "NG" regarding to the influence on the ejection, and a condition where the gap A is 3.0 mm, the gap B is 2.5 mm to 3.0 mm, and a condition where the gap A is 4.0 mm, and the gap B is 2.0 mm to 3.0 mm result in "NG" regarding to the influence on the irradiation. Thus, when the transport speed is 30 m/min, the gap C is 0.6 mm, and the suction air volume is 2.0V, setting the gap A to 3.0 mm and the gap B to 2.0 mm is most suitable for setting the wind speed in the gap B to about −2.0 m/sec.

When the transport speed is 50 m/min, the gap C is 0.6 mm, and the suction air volume is 2.0V, a condition where the gap A is 1.0 mm, and the gap B is 1.5 mm to 2.5 mm results in "NG" regarding to the influence on the ejection, and a condition where the gap A is 2.0 mm, the gap B is 2.0 mm to 2.5 mm, and a condition where the gap A is 3.0 mm, and the gap B is 1.5 mm to 2.5 mm result in "NG" regarding to the influence on the irradiation. Thus, when the transport speed is 50 m/min, the gap C is 0.6 mm, and the suction air volume is 2.0V, setting the gap A to 2.0 mm and the gap B to 1.5 mm is most suitable for setting the wind speed in the gap B to about −2.0 m/sec.

Note that, among the three factors, when the suction air volume is fixed and the gap A and the gap B are adjusted, it is sufficient that respective values of the gap A and the gap B corresponding to the transport speed for making the airflow in the gap B the airflow in the direction opposite to the transport direction D are stored in the memory 63 as a table.

Accordingly, when the transport speed of the base material S is set at the time of printing, the CPU 62 reads the table from the memory 63 and determines respective values of the gap A and the gap B corresponding to the set transport speed. Then, the CPU 62, by the open/close amount adjustment step for adjusting the open/close amount of the shutter 80, drives the shutter drive unit 85 via the control circuit 64 to adjust the open/close amount of the shutter 80, thereby adjusting the gap A.

In addition, the CPU 62, by the displacement adjustment step for adjusting the displacement of the auxiliary duct 73, drives the auxiliary duct drive unit 75 via the control circuit 64 to move the auxiliary duct 73, thereby adjusting the gap B. Then, the CPU 62 operates the mist retrieving unit 70 via the control circuit 64 to start driving of the fan, and start retrieval of mist. With this series of operations, the mist is efficiently retrieved by the mist retrieving section 71.

The adjustment step of the present embodiment includes the open/close amount adjustment step for adjusting the open/close amount of the shutter 80 in order to adjust the gap A. Furthermore, the adjustment step includes the displacement adjustment step for adjusting the displacement of the auxiliary duct 73 in order to adjust the gap B.

As described above, according to the printer 1A, and the printing method for the printer 1A according to the present embodiment, the following advantages can be achieved.

According to the printer 1A of the present embodiment, the controller 60 as the control unit adjusts the gap A and the gap B, among the gap A, the gap B, and the suction air volume of the mist retrieving section 71, in accordance with the transport speed of the base material S, such that the direction of the airflow passing through the gap between the base material S and the irradiation section 41 (the gap B between the base material S and the suction port 731) is in the direction opposite to the transport direction D of the base material S.

Accordingly, by adjusting the gap A and the gap B, that are two of the three factors, the direction of the airflow passing through the gap between the base material S and the irradiation unit 41 (the gap B between the base material S and the suction port 731) can be made the direction opposite to the transport direction D of the base material S. Thus, it becomes possible to improve the retrieval efficiency of the mist, and it is possible to suppress the mist from attaching to the irradiation section 41, thereby making it possible to suppress defects such as bleeding of printing or the like. In addition, since the retrieval efficiency of the mist can be improved, an increase in an amount of mist associated with speeding up of printing in recent printing apparatuses can be supported.

According to the printer 1A of the present embodiment, the shutter 80 capable of adjusting the open/close amount between the suction duct 72 in which the suction port 721 is provided at one end of the mist retrieving section 71 and the printing head 31 is included, and the open/close amount of the shutter 80 is adjusted when the gap A is adjusted. With this configuration, the gap A can be easily adjusted.

According to the printer 1A of the present embodiment, the suction duct 72 includes the auxiliary duct 73 that is movable to and from the base material S, and when the gap B is adjusted, the auxiliary duct 73 is moved. With this configuration, it is possible to easily adjust the gap B.

According to the printing method for the printer 1A of the present embodiment, the adjustment step is included in which the controller 60 as the control unit adjusts the gap A and the gap B, among the gap A, the gap B, and the suction air volume of the mist retrieving section 71, in accordance with the transport speed of the base material S, such that the direction of the airflow passing through the gap between the base material S and the irradiation section 41 (the gap B between the base material S and the suction port 721) is in the direction opposite to the transport direction D of the base material S.

Since the adjustment step is included for adjusting the gap A and the gap B, that are two of the three factors, the direction of the airflow passing through the gap between the base material S and the irradiation section 41 (the gap B between the base material S and the suction port 721) can be made the direction opposite to the transport direction D of the base material S. Thus, it becomes possible to improve the retrieval efficiency of the mist, and it is possible to suppress the mist from attaching to the irradiation section 41, thereby making it possible to suppress defects such as bleeding of printing or the like. In addition, since the retrieval efficiency of the mist can be improved, an increase in an amount of mist associated with speeding up of printing in recent printing apparatuses can be supported.

According to the printing method for the printer 1A of the present embodiment, the shutter 80 capable of adjusting the open/close amount between the suction duct 72 in which the suction port 721 is provided at the one end of the mist retrieving section 71 and the printing head 31 is included, and the open/close amount adjustment step for adjusting the open/close amount of the shutter 80, in order to adjust the gap A, is included. According to this printing method, the gap A can be easily adjusted by performing the open/close amount adjustment step for adjusting the open/close amount of the shutter 80.

According to the printing method for the printer 1A of the present embodiment, the suction duct 72 includes the auxiliary duct 73 that is movable to and from the base material S, and in order to adjust the gap B, the displacement adjustment step for adjusting the displacement of the auxiliary duct 73 is included. With this printing method, the gap B can be easily adjusted by performing the displacement adjustment step for adjusting the displacement of the auxiliary duct 73.

Note that, the present disclosure is not limited to the embodiments described above, and various modifications and improvements can be added to the above-described embodiments. Modifications are described below.

Modification 1

In the printer 1 of the first embodiment, the suction air volume of the mist retrieving section 71 is adjusted, among the gap A, the gap B, and the suction air volume of the mist retrieving section 71, in accordance with the transport speed of the base material S, such that the direction of the airflow passing through the gap B is in the direction opposite to the transport direction D of the base material S. In addition, in the printer 1A of the second embodiment, the gap A and the gap B are adjusted, among the gap A, the gap B, and the suction air volume of the mist retrieving section 71. However, the present disclosure is not limited thereto, and it is sufficient that at least one of the gap A, the gap B, and the suction air volume of the mist retrieving section 71 is adjusted.

Modification 2

In the printing method for the printer 1 of the first embodiment, the adjustment step is included for adjusting the suction air volume of the mist retrieving section 71, among the gap A, the gap B, and the suction air volume of the mist retrieving section 71, in accordance with the transport speed of the base material S, such that the direction of the airflow passing through the gap B is in the direction opposite to the transport direction D of the base material S. In addition, in the printing method for the printer 1A of the second embodiment, the adjustment step is included in which the gap A and the gap B are adjusted, among the gap A, the gap B, and the suction air volume of the mist retrieving section 71. However, the present disclosure is not limited thereto, and it is sufficient that the adjustment step is included for adjusting at least one of the gap A, the gap B, and the suction air volume of the mist retrieving section 71.

Modification 3

In the first and second embodiments, a reference of the wind speed of the airflow at which the direction of the airflow passing through the gap B is in the direction opposite to the transport direction D of the base material S is −2.0 m/sec, but the present disclosure is not limited to this value, and it is sufficient to confirm by the printing apparatus and set a wind speed suitable for the printing apparatus as a reference.

Fourth Modification

In the second embodiment, in order to adjust the gap B, in addition to the suction duct 72, an auxiliary duct 73 that is movable to and from the base material S is included. However, the present disclosure is not limited to this configuration, and a configuration may be adopted in which the suction duct 72 is movable to and from the base material S.

Modified Example 5

The gap A between the printing head 31 and the mist retrieving section 71 is fixed in the first embodiment, and is adjusted in the second embodiment. Note that, the gap A can be set to "0 mm" as an adjusted value. Note that, the gap B cannot be set to "0 mm" as an adjusted value. In addition, the suction air volume of the mist retrieving section 71 cannot be set to "0V".

Modified Example 6

In the printers 1 and 1A of the respective first and second embodiments, the printing head 31 uses the four printing heads corresponding to the four color inks. However, the present disclosure is not limited thereto, and one printing head may be used corresponding to one color, or five or more printing heads may be used corresponding to five or more colors.

Modification Example 7

The printers 1 and 1A of the respective first and second embodiments have been described by applying the present disclosure to the temporary curing irradiation section 41 as the irradiation unit 40 to which the mist attaches. However, the present disclosure is not a limited thereto, and the present disclosure may be applied to the actual curing irradiation section 42 as the irradiation unit 40 to which the mist attaches.

Contents derived from the above-mentioned embodiments are described below.

A printing apparatus is a printing apparatus that includes a line type printing head configured to eject an ultraviolet-curable ink onto a base material, an ultraviolet irradiator disposed downstream the printing head in a transport direction of the base material, a mist retrieving section having a suction port disposed between the printing head and the ultraviolet irradiator in the transport direction of the base material, and a control unit, wherein when the ultraviolet-curable ink is ejected toward the base material being transported to perform printing, the control unit, in accordance with a transport speed of the base material, adjusts at least one of a gap A and a gap B described below, and suction air volume of the mist retrieving section, such that a direction of an airflow passing through a gap between the base material and the ultraviolet irradiator is in a direction opposite to the transport direction of the base material.

Gap A: a gap between the printing head and the mist retrieving section

Gap B: a gap between the base material and the suction port

According to this configuration, the control unit adjusts at least one of the gap A, the gap B, and the suction air volume of the mist retrieving section, in accordance with the transport speed of the base material such that the direction of the airflow passing through the gap between the base material and the ultraviolet irradiator is in the direction opposite to the transport direction of the base material.

Accordingly, by adjusting at least one of the three factors, the direction of the airflow passing through the gap between the base material and the ultraviolet irradiator (the gap B between the base material and the suction port) can be made the direction opposite to the transport direction of the base material. Thus, it becomes possible to improve the retrieval efficiency of the mist, and it is possible to suppress the mist from attaching to the ultraviolet irradiator, thereby making it possible to suppress defects such as bleeding of printing or the like. In addition, since the retrieval efficiency of the mist can be improved, an increase in an amount of mist associated with speeding up of printing in recent printing apparatuses can be supported.

When the gap A and the gap B are fixed and the suction air volume is adjusted, the above described printing apparatus may increase, compared to the suction air volume when the transport speed is a first transport speed, the suction air volume when the transport speed is a second transport speed faster than the first transport speed to be larger.

According to this configuration, a mechanical and electrical configuration is necessary to adjust the gap A and the gap B, but it is sufficient, for example, to adjust a drive voltage of a fan to adjust the suction air volume, thus adjustment is facilitated. Furthermore, when the transport speed of the base material is increased, it is possible to improve the retrieval efficiency of the mist by adjusting the suction air volume, so as to increase the suction air volume, and the speeding up of printing can be easily supported.

The printing apparatus described above, in the transport direction of the base material, may include a shutter capable of adjusting an open/close amount between a suction duct including the suction port provided at one end of the mist retrieving section and the printing head, and may adjust the open/close amount of the shutter when the gap A is adjusted.

According to this configuration, it is sufficient that the open/close amount of the shutter is adjusted when the gap A is adjusted, thus it is possible to easily adjust the gap A.

As described above, in the printing apparatus, the suction duct may include an auxiliary duct that is movable to and from the base material, and the auxiliary duct may be moved when the gap B is adjusted.

According to this configuration, it is sufficient that the auxiliary duct is moved when the gap B is adjusted, thus it is possible to easily adjust the gap B.

A printing method in a printing apparatus is a printing method for a printing apparatus that includes a line type printing head configured to eject an ultraviolet-curable ink onto a base material, an ultraviolet irradiator disposed downstream the printing head in a transport direction of the base material, and a mist retrieving section having a suction port disposed between the printing head and the ultraviolet irradiator in the transport direction of the base material, the printing method including, an adjustment step, when the ultraviolet-curable ink is ejected toward the base material being transported to perform printing, in accordance with a transport speed of the base material, for adjusting at least one of a gap A and a gap B described below, and suction air volume of the mist retrieving section, such that a direction of an airflow passing through a gap between the base material and the ultraviolet irradiator is in a direction opposite to the transport direction of the base material.

Gap A: a gap between the printing head and the mist retrieving section

Gap B: a gap between the base material and the suction port

According to this method, the adjustment step is included for adjusting at least one of the gap A, the gap B, and the suction air volume of the mist retrieving section, in accordance with the transport speed of the base material, such that the direction of the airflow passing through the gap between the base material and the ultraviolet irradiator is in the direction opposite to the transport direction of the base material.

Accordingly, by adjusting at least one of the three factors by the adjustment step, the direction of the airflow passing through the gap between the base material and the ultraviolet irradiator (the gap B between the base material and the suction port) can be made the direction opposite to the transport direction of the base material. Thus, it becomes possible to improve the retrieval efficiency of the mist, and it is possible to suppress the mist from attaching to the ultraviolet irradiator, thereby making it possible to suppress defects such as bleeding of printing or the like. In addition, since the retrieval efficiency of the mist can be improved, an increase in an amount of mist associated with speeding up of printing in recent printing apparatuses can be supported.

In the printing method described above, when the gap A and the gap B are fixed and the suction air volume is adjusted, the adjustment step may include a step for increasing, compared to the suction air volume when the transport speed is a first transport speed, the suction air volume when the transport speed is a second transport speed faster than the first transport speed to be larger.

According to this method, a mechanical and electrical configuration is necessary to adjust the gap A and the gap B, but it is sufficient, for example, to adjust a drive voltage of a fan to adjust the suction air volume, thus adjustment is facilitated. Furthermore, when the transport speed of the base material is increased, it is possible to improve the retrieval efficiency of the mist by adjusting the suction air volume, by the step for increasing the suction air volume, and the speeding up of printing can be easily supported.

The printing method described above, in the transport direction of the base material, may include a shutter capable of adjusting an open/close amount between a suction duct including the suction port provided at one end of the mist retrieving section and the printing head, and the adjustment step may include an open/close amount adjustment step for adjusting the open/close amount of the shutter in order to adjust the gap A.

According to this method, the gap A can be easily adjusted by performing the open/close amount adjustment step for adjusting the open/close amount of the shutter.

In the printing method described above, the suction duct may include an auxiliary duct that is movable to and from the base material, and the adjustment step may include, in order to adjust the gap B, a displacement adjustment step for adjusting displacement of the auxiliary duct.

According to this method, the gap B can be easily adjusted by performing the displacement adjustment step for adjusting the displacement of the auxiliary duct.

What is claimed is:

1. A printing apparatus, comprising:

a line type printing head configured to eject an ultraviolet-curable ink onto a base material;

an ultraviolet irradiator disposed downstream of the printing head in a transport direction of the base material;

a mist retrieving section having a suction port and disposed between the printing head and the ultraviolet irradiator in the transport direction of the base material; and a control unit, wherein when printing is performed with the ultraviolet-curable ink being ejected toward the base material to be transported, the control unit adjusts, in accordance with a transport speed of the base material, at least one of a gap A and a gap B described below, and a suction air volume of the mist retrieving section such that a direction of an airflow passing through a gap between the base material and the ultraviolet irradiator is opposite the transport direction of the base material:

Gap A: a gap between the printing head and the mist retrieving section

Gap B: a gap between the base material and the suction port, wherein, when the suction air volume is adjusted with the gap A and the gap B being fixed, the suction air volume when the transport speed is a second transport speed is caused to be greater than the suction air volume when the transport speed is a first transport speed, the second transport speed being faster than the first transport speed.

2. The printing apparatus according to claim 1, comprising, in the transport direction of the base material, a shutter configured to adjust an open/close amount and provided between a suction duct including the suction port provided at one end of the mist retrieving section, and the printing head, wherein the open/close amount of the shutter is adjusted when the gap A is adjusted.

3. A printing apparatus, comprising:

a line type printing head configured to eject an ultraviolet-curable ink onto a base material;

an ultraviolet irradiator disposed downstream of the printing head in a transport direction of the base material;

a mist retrieving section having a suction port and disposed between the printing head and the ultraviolet irradiator in the transport direction of the base material, a suction duct including the suction port being provided at one end of the mist retrieving section, the suction duct includes an auxiliary duct configured to move to and from the base material;

a control unit, wherein when printing is performed with the ultraviolet-curable ink being ejected toward the base material to be transported, the control unit adjusts, in accordance with a transport speed of the base material, at least one of a gap A and a gap B described below, and a suction air volume of the mist retrieving section such that a direction of an airflow passing through a gap between the base material and the ultraviolet irradiator is opposite the transport direction of the base material:

Gap A: a gap between the printing head and the mist retrieving section,

Gap B: a gap between the base material and the suction port, and wherein, in the transport direction of the base material, a shutter is configured to adjust an open/close amount and provided between the suction duct including the suction port provided at one end of the mist retrieving section, and the printing head, wherein, the open/close amount of the shutter is adjusted when the gap A is adjusted, and the auxiliary duct is moved when the gap B is adjusted.

4. A printing method for a printing apparatus that includes a line type printing head configured to eject an ultraviolet-curable ink onto a base material, an ultraviolet irradiator disposed downstream of the printing head in a transport direction of the base material, and a mist retrieving section having a suction duct including a suction port and disposed between the printing head and the ultraviolet irradiator in the transport direction of the base material, the printing method comprising an adjustment step for, when printing is performed with the ultraviolet-curable ink being ejected toward the base material to be transported, adjusting, in accordance with a transport speed of the base material, at least one of a gap A and a gap B described below, and a suction air volume of the mist retrieving section such that a direction of an airflow passing through a gap between the base material and the ultraviolet irradiator is opposite the transport direction of the base material:

Gap A: a gap between the printing head and the mist retrieving section,

Gap B: a gap between the base material and the suction port, wherein, when the suction air volume is adjusted with the gap A and the gap B being fixed, the adjustment step includes causing the suction air volume when the transport speed is a second transport speed to be greater than the suction air volume when the transport speed is a first transport speed, the second transport speed being faster than the first transport speed.

5. The printing method according to claim 4, wherein in the transport direction of the base material, a shutter configured to adjust an open/close amount is provided between the suction duct including the suction port provided at one end of the mist retrieving section, and the printing head, and the adjustment step includes an open/close amount adjustment step for adjusting the open/close amount of the shutter to adjust the gap A.

6. The printing method according to claim 5, wherein the suction duct includes an auxiliary duct configured to move to and from the base material, and the adjustment step includes a movement amount adjustment step for adjusting a movement amount of the auxiliary duct to adjust the gap B.

* * * * *